US006418035B1

(12) United States Patent
Yu

(10) Patent No.: US 6,418,035 B1
(45) Date of Patent: Jul. 9, 2002

(54) RETENTION MECHANISM WITH IMPROVED HOLD-DOWN STRUCTURE FOR SECURING THE RETENTION MECHANISM TO A PRINTED CIRCUIT BOARD

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/632,370

(22) Filed: Aug. 3, 2000

(30) Foreign Application Priority Data

May 19, 2000 (TW) ..... 089208487

(51) Int. Cl.[7] ..... H01R 13/621

(52) U.S. Cl. ..... 361/809; 361/740; 361/741; 361/807; 361/825; 439/377; 439/564; 439/567; 439/573; 211/41.17

(58) Field of Search ..... 361/740, 741, 361/756, 759, 801, 802, 807–810, 825, 684, 686; 439/377, 564, 567, 573; 211/41.17

(56) References Cited

U.S. PATENT DOCUMENTS 5,829,601 A * 11/1998 Yurchenko et al. ..... 211/41.17
6,031,725 A * 2/2000 Scholder et al. ..... 361/759
6,098,938 A * 8/2000 Tsai ..... 361/684
6,112,911 A * 9/2000 Laurx ..... 211/41.17
6,116,566 A * 9/2000 Brown et al. ..... 361/759
6,147,873 A * 11/2000 Huang ..... 361/759

* cited by examiner

*Primary Examiner*—David L. Talbott
*Assistant Examiner*—John B. Vigushin
(74) *Attorney, Agent, or Firm*—Wei Te Chung

(57) ABSTRACT

A retention mechanism 1 mounted on a PCB comprises a retention housing 10, a pair of board lock posts 30 extending through a bottom plate 15 of the housing and retained in the PCB and a pair of pins 20. The retention housing defines a slot 11 receiving an end of an electrical connector and comprises a rear wall 12 from which at least a stopper 13 projects. Each pin comprises a head portion 21 and a pin body 22 for inserting into a hole 33 defined in a corresponding post. The head portion comprises a planar side surface 211 and an aucute side surface 212. A distance between a longitudinal axis of the pin body and a front face 132 of the stopper is shorter than a distance between the axis and the arcuate side surface and is longer than a distance between the axis and the planar side surface. Each pin is rotated a proper angle in the board lock post so that the head portion thereof is depressed downwardly by a corresponding stopper, securely retaining the pin in the board lock post in conditions of shock and vibration.

12 Claims, 6 Drawing Sheets

RETENTION MECHANISM WITH IMPROVED HOLD-DOWN STRUCTURE FOR SECURING THE RETENTION MECHANISM TO A PRINTED CIRCUIT BOARD

BACKGROUND OF THE INVENTION

1. Field of the Invention

The present invention relates to a retention mechanism for securing an upright CPU module to a socket connector mounted on a printed circuit board (PCB), and particularly to a retention mechanism having an improved hold-down structure for securing the retention mechanism to the PCB.

2. Description of the Prior Art

A retention mechanism has been developed to retain an upright CPU module in a slot connector mounted on a mother board, as is disclosed in prior art Taiwan patent application Nos. 86211054 and 86207803 and U.S. Pat. No. 6,031,725.

Referring to FIG. 6, a prior art retention mechanism 4 comprises a retention housing 40, at least one board lock post 60 and at least one pin 50 fitting in the post 60. The housing 40 has a rear wall 41 and a pair of bottom plates 42 extending forward from the rear wall 41. A slot 43 is defined in a middle, lower portion of the housing 40 and between a pair of side walls 45 for fittingly receiving one end of a slot connector (not shown) mounted on a PCB (not shown). The board lock post 60 comprises a cylindric head 61 and an insertion leg 63 to be inserted through a hole 44 defined in the bottom plate 42 and retained in the PCB. A hole 62 is defined in the post 60. When the pin 50 is inserted into the hole 62, it expands the insertion leg 63 to complete a secure connection between the retention mechanism 4 and the PCB. A passage 46 is formed between a pair of heat sink fixing brackets 48 and is located above and communicating with the slot 43. A lateral edge of the CPU module is inserted through the passage 46 to a position where the module is electrically connected with the slot connector.

However, there is no structure which can effectively hold the pin 50 in position in the hole 62. Thus, the pin 50 may spring out of the post 60 because of vibration during transportation and use, which will result in the retention mechanism 40 not effectively retaining the CPU module to the slot connector, thereby adversely affecting the electrical connection therebetween.

Hence, an improved retention mechanism is required to overcome the disadvantages of the prior art.

BRIEF SUMMARY OF THE INVENTION

A main object of the present invention is to provide a retention mechanism which is provided with a hold-down structure for securing the mechanism to a PCB.

To fulfil the above mentioned object, a retention mechanism of the present invention comprises a retention housing, a pair of board lock posts extending through a bottom plate of the housing and retained in the PCB and a pair of pins. The retention housing defines a slot for effectively accommodating one end of an electrical connector therein and comprises a rear wall from which at least a stopper projects. Each pin comprises a head portion and a pin body inserted in a corresponding board lock post. The head portion is formed by symmetrically cutting out two arc portions from a dummy cylinder and comprises a pair of planar side surfaces and a pair of arcuate side surfaces. A distance between a longitudinal axis of the pin body and a front face of the stopper is shorter than that between the axis and an arcuate side surface, while it is longer than that between the axis and the planar side surface. The pin is rotatably turned a proper angle in a corresponding board lock post so that the head portion thereof is depressed by a corresponding stopper, which keeps the pin from springing out of the post during transportation and use.

Other objects, advantages and novel features of the invention will become more apparent from the following detailed description of the present embodiment when taken in conjunction with the accompanying drawings.

DETAILED DESCRIPTION OF THE INVENTION

Figure 1:
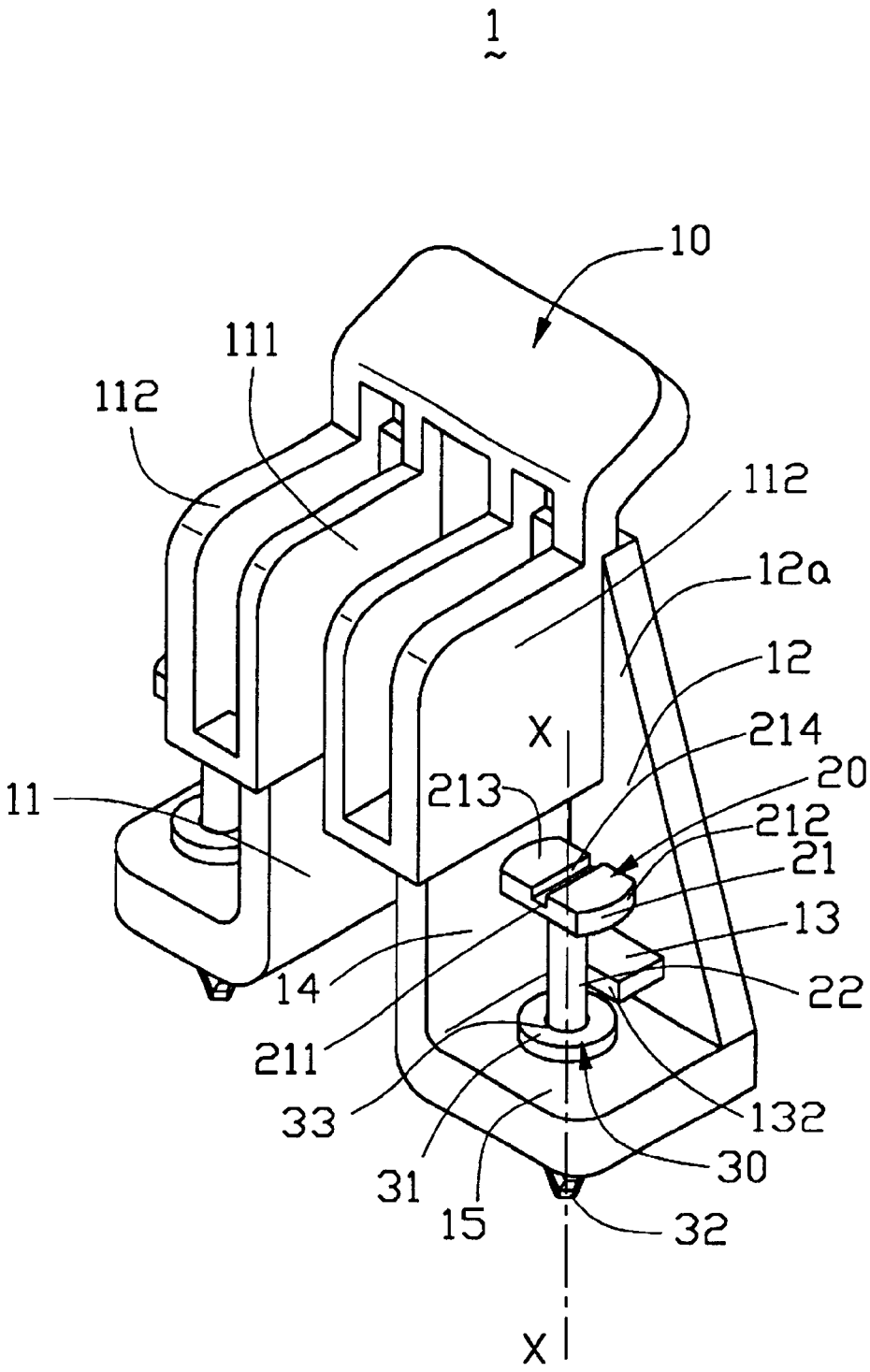
FIG. 1 is a perspective view of a retention mechanism of the present invention.
Figure 2:
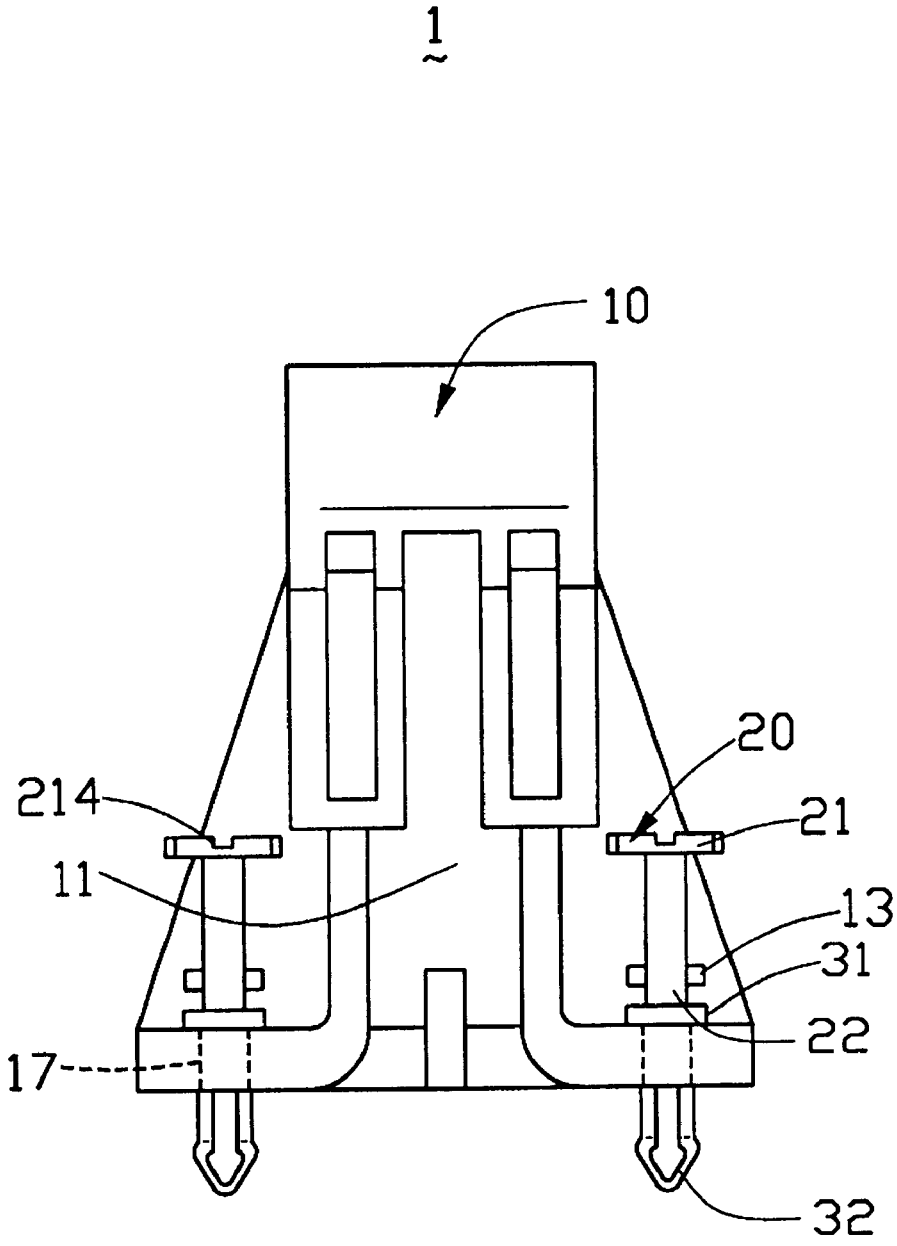
FIG. 2 is a front planar view of FIG. 1.
Figure 3:
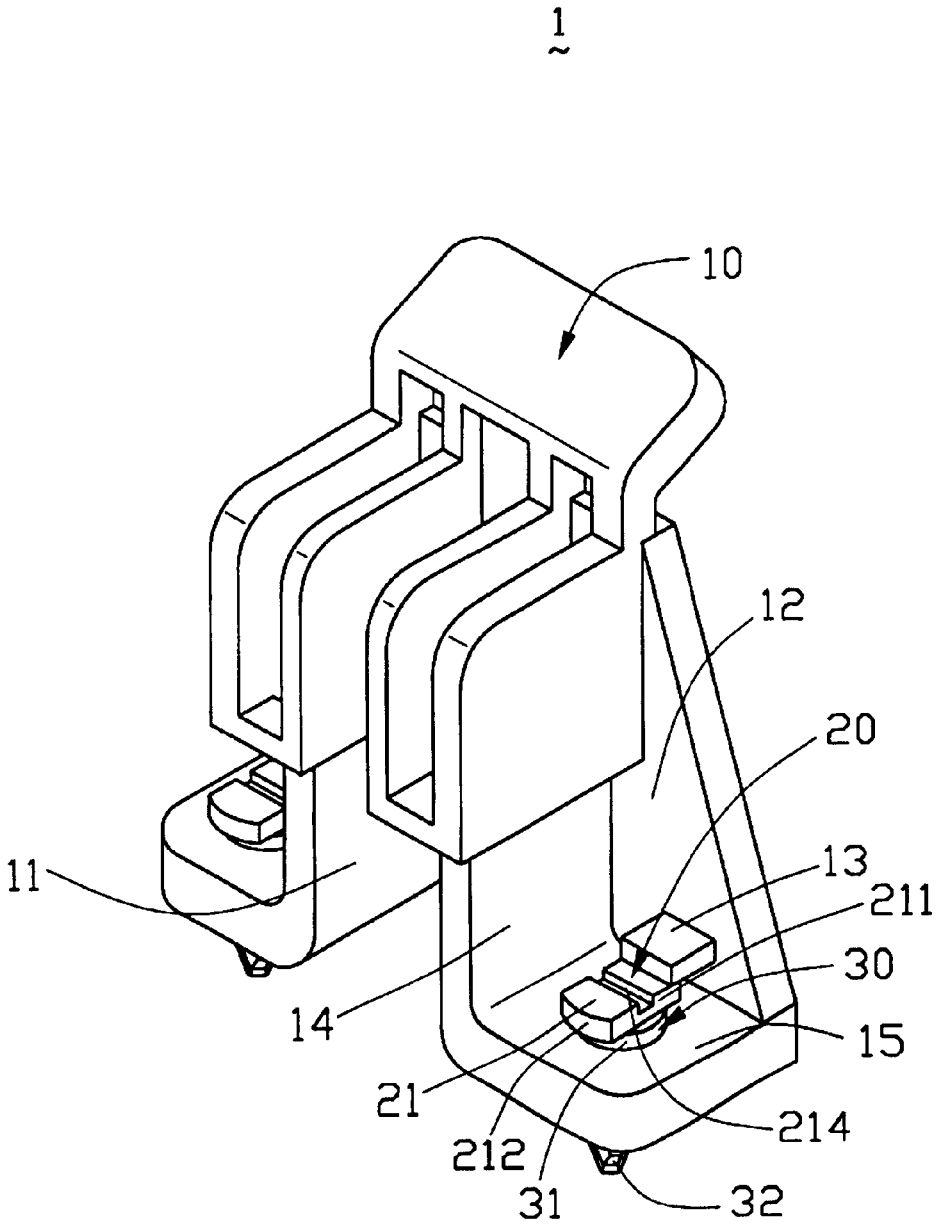
FIG. 3 is similar to FIG. 1 wherein a pin is completely pushed into a board lock post and is rotated to be depressed by a stopper of the retention mechanism.
Figure 4:
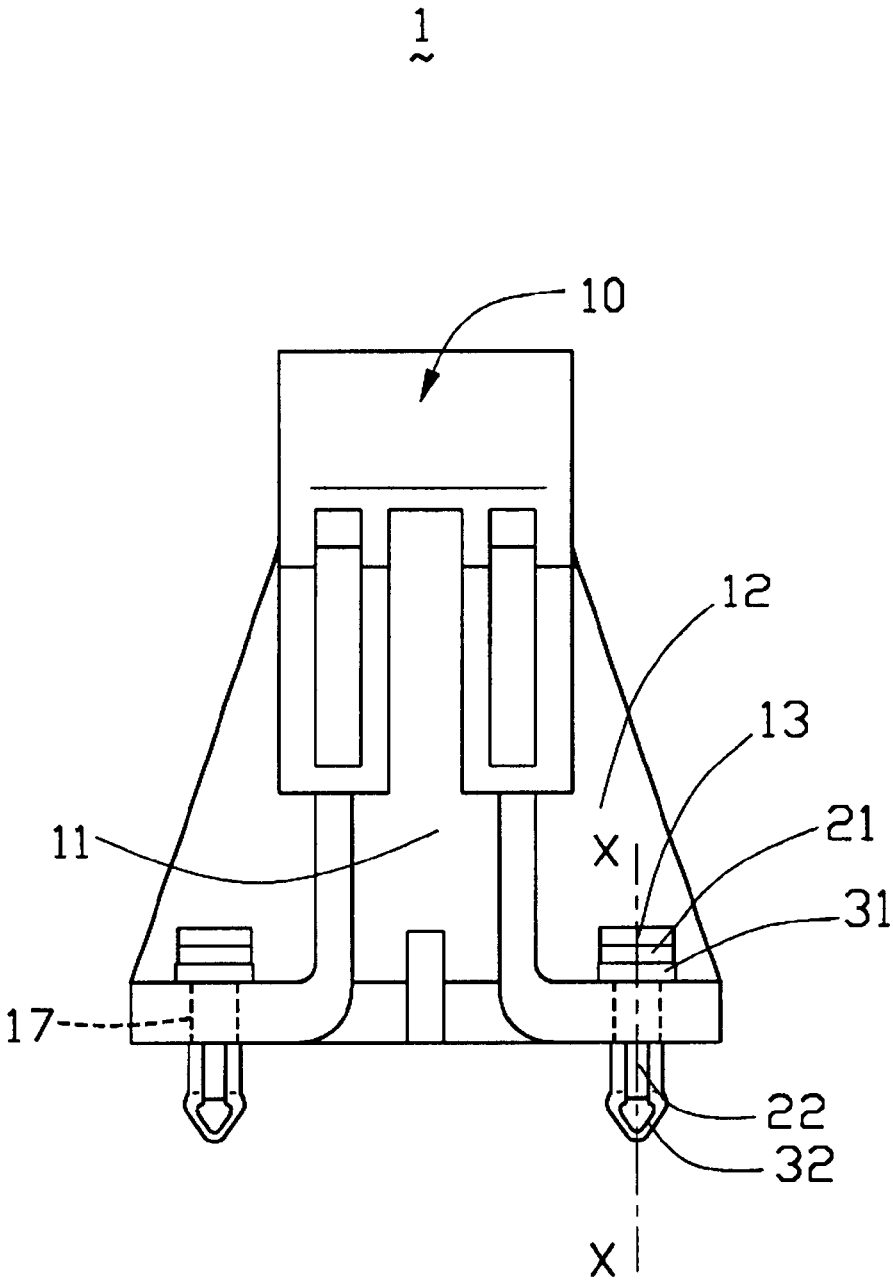
FIG. 4 is a front planar view of FIG. 3.
Figure 5:
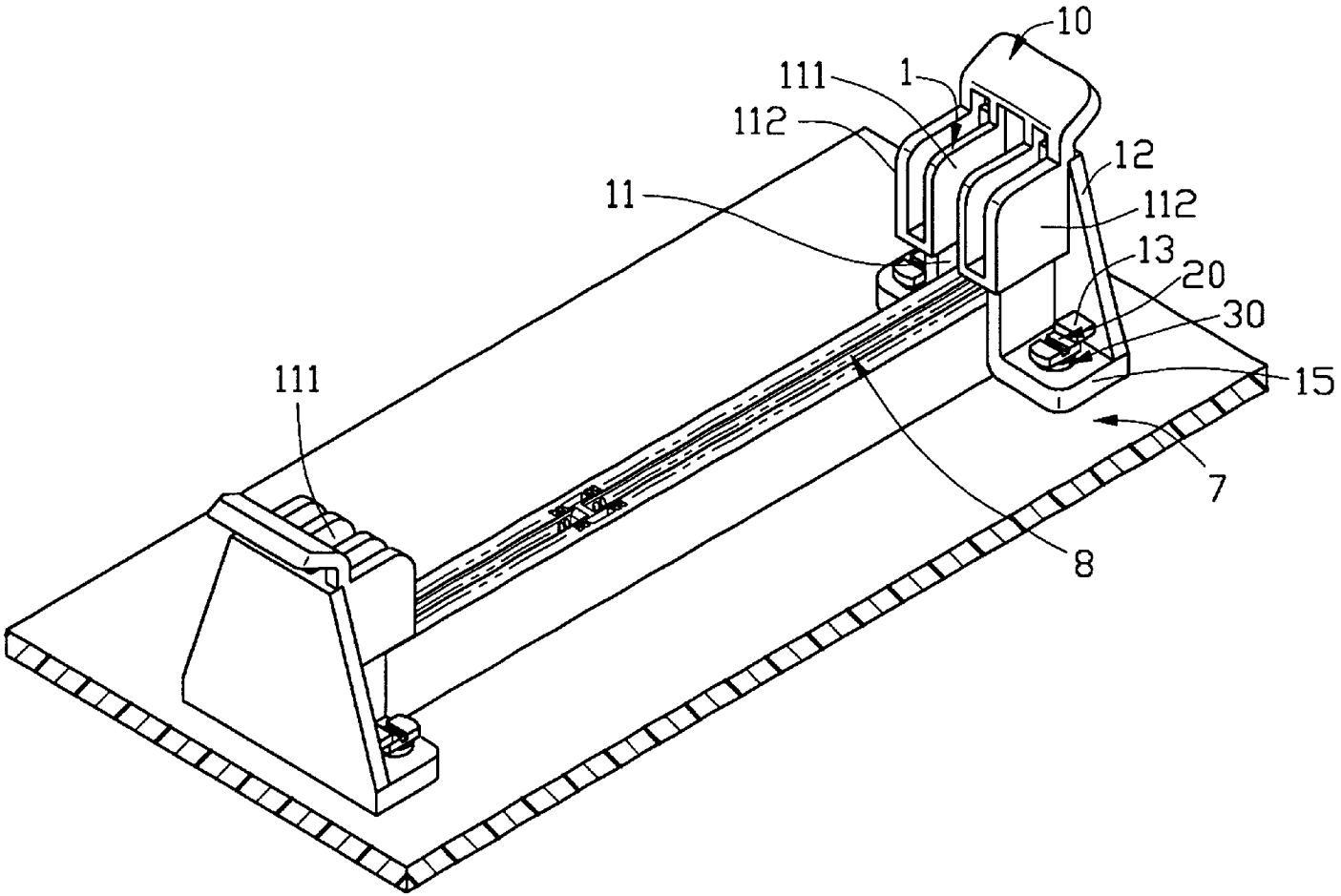
FIG. 5 is a perspective view of an assembly of a pair of the retention mechanisms shown in FIG. 3, a connector and a PCB.

Referring to FIGS. 1 and 2, a retention mechanism 1 in accordance with the present invention comprises a retention housing 10, a pair of board lock posts 30 retained in the retention housing 10 and a pair of pins 20 partially received in the board lock posts 30. The board lock posts 30 and the pins 20 are configured to cooperatively mount the retention housing 10 onto a PCB 7 (FIG. 5). Each board lock post 30 has a similar structure as that of the conventional post 60 of FIG. 6. Furthermore, each pin 20, except for a head portion 21 thereof, has a same structure as that of the conventional pin 50 of FIG. 6.

The retention housing 10 is symmetric about a plane through the housing's lateral axis and includes a rear wall 12. A pair of bottom plates 15 extends forward from a lower end of a front surface 12*a* of the rear wall 12. Each bottom plate 15 defines a hole 17 therethrough. A pair of side walls 14 extend upward from two confronting sides of the two bottom plates 15 and connect with the rear wall 12, thereby, together with the rear wall 12, defining a slot 11 therebetween for accommodating one end of an electrical socket connector 8 (FIG. 5). In addition, a pair of stoppers 13 project forward from a front surface 12*a* of the rear wall 12 each aligned with a corresponding hole 17 and located above and oriented parallel to a corresponding bottom plate 15, respectively.

Each board lock post 30 comprises a cylindric head 31 and an insertion leg 32 extending through a corresponding hole 17 defined in each bottom plate 15 and retained in a bore (not shown) in a PCB 7 (FIG. 5). The board lock post 30 further defines a hole 33 extending axially along a full length of the board lock post 30.

Each of the pins 20 comprises a horizontal head portion 21 and a pin body 22 extending vertically downward from a bottom surface (not labeled) of the head portion 21. The head portion 21 is formed by symmetrically cutting out two arc portions from an originally cylindrical head portion similar to the head portion of the prior art. Thus, the head portion comprises a pair of opposite planar side surfaces 211 and a pair of opposite arcuate side surfaces 212. Furthermore, the head portion 21 is constructed such that a distance between a longitudinal axis X—X of the pin body 22 and a front face 132 of a corresponding stopper 13 is shorter than that between the axis X—X and the arcuate side surface 212, and longer than that between the axis X—X and the planar side surface 211. The head portion 21 further defines a slot 214 in a flat upper surface 213 thereof for rotating the pin 20 in the hole 33 of the board lock post 30 using a tool (not shown), such as a flat screwdriver.

In assembly, referring to FIGS. 1 to 5, the connector 8 is soldered to the PCB 7. A pair of the retention mechanisms 1 are positioned at two ends (not labeled) of the connector 8 with the slots 11 thereof accommodating the lateral ends of the connector 8. The insertion legs 32 of the board lock posts 30 are inserted through the holes 17 of the bottom plates 15 and are retained in the bores of the PCB 7 until the cylindric heads 31 thereof abut against the bottom plates 15. The pin bodies 22 of the pins 20 are then inserted into the holes 33 of the board lock posts 30 with the planar side surfaces 211 thereof generally parallel to corresponding front faces 132 of the stoppers 13. The inserted pin bodies 22 expand the insertion legs 32 to urge the insertion legs 32 to be securely retained in the PCB 7. Finally, the head portions 21 are turned a proper angle, namely 90 degrees, for example, by inserting a blade of a screwdriver into the slot 214 of each head portion 21 and rotating the screwdriver to successively turn the head portions 21. As a result, each stopper 13 depresses an upper surface 213 of the head portion 21 of a corresponding pin 20, thereby preventing the pins 20 from disengaging from the board lock posts 30 in a shock or vibration condition so as to secure the retention mechanism 1 onto the PCB 7. It can be noted that dimple/recess structures may be applied to both the stopper 13 and the head portion 21 for preventing relative rotation therebetween.

Figure 6:
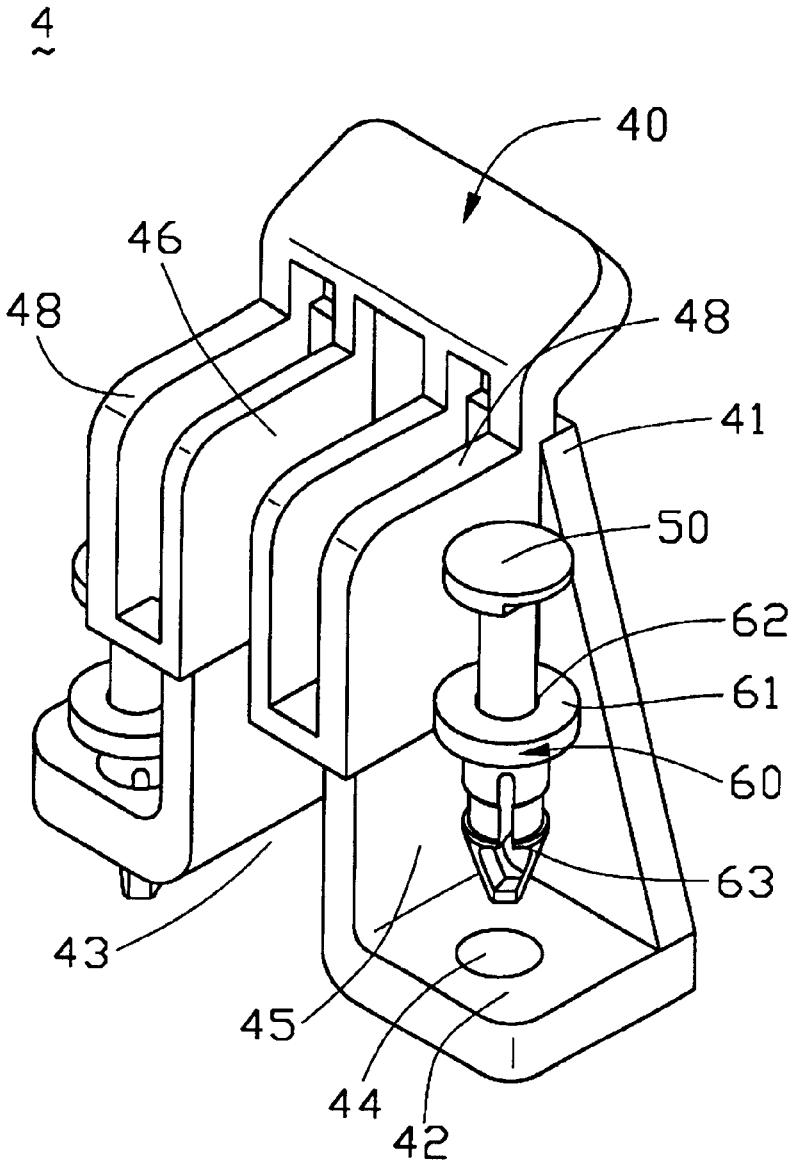
FIG. 6 (PRIOR ART)
FIG. 6 is a perspective view of a prior art retention mechanism.

Like the housing 40 of the conventional retention mechanism of FIG. 6, the retention housing 10 of each retention mechanism 1 of the present invention has a pair of heat sink fixing brackets 112. The brackets 112 define a passage 111 therebetween. The passage 111 is located above and in communication with a corresponding slot 11. When a CPU module (not shown), for example, an Intel Celeron™ CPU module is mounted in the connector 8, lateral edges of the module are inserted through the passages 111 to a position where golden fingers on a lower edge of the CPU module electrically engage with contacts (not shown) of the connector 8, and the lateral edges of the module are sandwiched between the brackets 112, respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retention mechanism for securing a CPU module engaged in a connector mounted on a printed circuit board, comprising:

a housing having a rear wall and a bottom plate extending forward from the rear wall, a slot adapted for receiving an end of the connector and a passage above and communicating with the slot, said passage being adapted for receiving a lateral edge of the CPU module;

a board lock post extending through the bottom plate and having an insertion leg retained in the printed circuit board; and a pin having an elongated head portion and a pin body extending downward from the head portion into the board lock post to expand the insertion leg of the board lock post;

wherein the rear wall of the housing has a stopper abutting against the head portion of the pin to prevent the pin from springing out of the board lock post when the retention mechanism is under a condition of vibration.

2. A retention assembly comprising:

a printed circuit board defining a bore;

a housing positioned on the printed circuit board, said housing defining a bottom plate with a hole extending therethrough in a vertical direction and in alignment with said bore;

a discrete hollow board lock post extending downwardly through both the hole of the bottom plate and the bore of the printed circuit board with thereof a head seated upon the bottom plate and an insertion leg around a distal end below said bottom plate; and a pin inserted downwardly into the board lock post to urge the insertion leg to retainably engage the printed circuit board so as to secure the bottom plate of the housing and the printed circuit board together; wherein the housing further includes a stopper abutting against a head of the pin to prevent the pin from upward movement relative to the housing; wherein the head of the pin is seated upon the head of the board lock post rather than is directly seated upon the bottom plate.

3. The assembly as claimed in claim 2, wherein the head has variable lateral dimensions thereof so as to allow the pin to be freely inserted into the board lock post without engagement with the stopper while being engaged with the stopper by the head after rotation of the pin.

4. A retention mechanism adapted for being mounted onto a PCB for retaining an electrical component onto the PCB, the retention mechanism comprising:

a retention housing comprising a rear wall, a pair of bottom plates extending forward from a lower end of a front surface of the rear wall, and a pair of side walls respectively extending upward from two confronting sides of the bottom plates and connecting with the rear wall thereby defining a slot for receiving the electrical component therebetween, the rear wall forming two stoppers on the front surface thereof, each of the stoppers being positioned above a corresponding bottom plate and having a front face, each bottom plate defining a hole therethrough;

a pair of board lock posts each comprising a head and an insertion leg adapted for being inserted through the hole of the bottom plate and adapted to be retained in the PCB, said post defining a hole extending through the head coaxially into the insertion leg; and a pair of pins each comprising a head portion and a pin body extending vertically downward from the head portion and inserted in the hole of a corresponding board lock post to expand the insertion leg, the head portion of each pin having a greater dimension in one horizontal direction and a less dimension in a perpendicular horizontal direction, the head portions of the pins being depressed by the stoppers of the retention housing when assembled in the retention housing so that the pins do not spring but of the board lock posts under a vibration environment.

5. The retention mechanism as claimed in claim 4, wherein the head portion comprises a planar side surface and an arcuate side surface, and, when the board lock post is inserted in the retention housing and the pin is inserted in the board lock post, a distance between the front face of the stopper and a longitudinal axis of the pin body is longer than the distance between the planer side surface and the longitudinal axis while being shorter than the distance between the longitudinal axis and the arcuate side surface.

6. The retention mechanism as claimed in claim 5, wherein each stopper extends parallel to a corresponding bottom plate.

7. The retention mechanism as claimed in claim 6, wherein when the board lock posts are fully inserted into the holes of the bottom plates, and each pin is inserted fully into a corresponding board lock post with the planar side surface parallel to a front face of a corresponding stopper, and then each pin is turned to a position where the arcuate side surface is beneath the corresponding stopper, the stopper will depress against the head portion of the pin.

8. The retention mechanism as claimed in claim 4, wherein the head portion of each pin is formed by symmetrically cutting out two arcuate portions from a dummy cylinder thereof.

9. The retention mechanism as claimed in claim 4, wherein the head of each board lock post abuts against a corresponding bottom plate after being retained in the PCB.

10. The retention mechanism as claimed in claim 4, wherein the head portion of each pin has an upper surface and defines a slot in the upper surface for engaging with a screwdriver.

11. A method of assembling a housing to a board, comprising steps of:

providing a housing with a bottom plate defining a hole therein, said housing further including a stopper thereon;

providing a board with a bore;

positioning the housing upon the board with the hole of the housing and the bore of the board vertically aligned with each other;

providing a hollow board lock post with thereof an insertion leg at a distal end and a head seated upon the bottom plate;

downwardly inserting said board lock post into both the hole of the bottom plate and the bore of the board;

providing a pin with a head; and downwardly inserting the pin into the board lock post and efficiently urging the insertion leg to retainably engage the board; wherein the head of the pin is arranged to be downwardly depressed by the stopper and directly downwardly abuts against the head of the board lock post for avoiding upward movement after the pin is fully inserted into the board lock post.

12. The method as claimed in claim 11, wherein said head has different diameters in different directions, and is rotated to be downwardly depressed by the stopper after the pin is first freely inserted into the board lock post.

* * * * *